US005129580A

United States Patent [19]

Schmitter

[11] Patent Number: 5,129,580

[45] Date of Patent: Jul. 14, 1992

[54] DEVICE FOR SPRAYING DISPERSE SYSTEMS

[75] Inventor: René Schmitter, Bartenheim, France

[73] Assignee: Lonza Ltd., Gampel/Valais, Switzerland

[21] Appl. No.: 685,919

[22] Filed: Apr. 16, 1991

[30] Foreign Application Priority Data

Apr. 27, 1990 [CH] Switzerland ..... 1441/90

[51] Int. Cl.[5] ..... B05B 1/16; B05B 1/32

[52] U.S. Cl. ..... 239/118; 239/533.1; 239/533.15; 239/551; 239/583

[58] Field of Search ..... 239/117, 118, 533.1, 239/533.15, 551, 562, 570, 583

[56] References Cited

U.S. PATENT DOCUMENTS

| | | | |
|---|---|---|---|
| 876,453 | 1/1908 | Heard . | |
| 1,007,325 | 10/1911 | Bohme . | |
| 1,630,974 | 5/1927 | Shelor et al. . | |
| 1,716,195 | 6/1929 | Stockstrom . | |
| 2,017,467 | 10/1935 | Loomis | 239/118 |
| 2,135,925 | 11/1938 | Tuscher | 239/533.1 |
| 2,794,683 | 6/1957 | Michaels . | |
| 3,203,629 | 8/1965 | Goddard | 239/533.1 X |
| 3,295,169 | 1/1967 | Moslo | 239/533.15 X |
| 4,010,903 | 3/1977 | Sakuri et al. | 239/533.1 |

FOREIGN PATENT DOCUMENTS

| | | | |
|---|---|---|---|
| 2450716 | 11/1975 | Fed. Rep. of Germany . | |
| 2724931 | 12/1977 | Fed. Rep. of Germany . | |
| 569852 | 1/1924 | France . | |
| 12565 | of 1911 | United Kingdom | 239/117 |

*Primary Examiner*—Andres Kashnikow
*Assistant Examiner*—William Grant
*Attorney, Agent, or Firm*—Fisher, Christen & Sabol

[57] ABSTRACT

A device for spraying of disperse systems, especially of graphite-containing lubricant dispersions, which consists of a spray head, an intake for a disperse system, with a plunger able to slide inside of the spray head in front of the opening of the hole type nozzle and a coupling connection to a supply element and in which the plunger exhibits one or more ducts which, going from the coupling side of the plunger through the plunger, comes out into a hollow space of the spray head.

18 Claims, 6 Drawing Sheets

DEVICE FOR SPRAYING DISPERSE SYSTEMS

BACKGROUND OF THE INVENTION

1. Field of the Invention

The invention relates to a device for spraying disperse systems.

2. Background Art

In a spray device belonging to the prior art, in a tubular spray head which has passage ducts for the liquid to be sprayed, a cleaning element is slidably mounted which, at the same time is connected to a tip which in a relative movement of the cleaning element to the spray head can slide into an opening of the hole type nozzle to clean this opening (French Patent No. 569,852). In such case, the cleaning is to follow without interruption of the normal function of the spray head.

Further, a spray valve for spraying viscous liquids, which is designed as a needle valve, is known (U.S. Pat. No. 2,794,683). A perforated disk is placed in a spray head of such needle valve concentric to its opening before the hole type nozzle. A plunger, slidable inside of the spray head, has on its head end a cylindrical or conical section which can be shoved through the perforated disk into the opening of the hole type nozzle to press dirt accumulation from such opening of the hole type nozzle.

From German Patent No. 2,724,931, a spray device is known in which a strainer screen and a stripping device are placed in the spray head between intake of the disperse systems and the hole type nozzle. Thus, it is to be achieved that the coarse-grained components of the disperse systems, which can clog the nozzle, are held back and stripped by force.

Especially in spraying of rollers in the hot shaping of sheets, hollow sections (pipes) or other sections with dispersions containing graphite, which takes place over a considerable period, such spray devices have not proved suitable, either because the strainer screen regularly clogged or the installation/removal proved to be too expensive and too time-consuming.

BROAD DESCRIPTION OF THE INVENTION

The main object of the invention is to provide a simply-designed, easily-cleanable and quickly-interchangeable device by which disperse systems, which contain coarse-grained materials or polymers tending to gum, can be sprayed without reduction of the throughput over a considerable period. This main object is achieved according to the invention by the design of the invention device for spraying with the features indicated herein (and by the invention process).

Other objects and advantages of the invention are set out herein or are obvious herefrom to one skilled in the art. The objects and advantages of the invention are achieved by the device and process of the invention.

The invention involves a device for the spraying of disperse systems. The invention device has a spray head with a hole type nozzle, an intake for disperse systems, with a plunger able to slide inside of the spray head in front of the opening of the hole type nozzle and a coupling connection to a supply element. Plunger (1) has one or more ducts for the disperse system which, going from the coupling side of the plunger through the plunger, comes out into hollow space (2) of spray head (5).

The device according to the invention is used for spraying disperse systems, preferably suspensions, containing graphite in an upper grain size of 25 to 150 microns as the disperse phase and a liquid as the dispersing agent. Such suspensions, especially those that, besides the dispersing agent, also contain portions of stabilizers, dispersion auxiliary agents and polymers, for example, according to German OS 2,450,716, were able to be sprayed poorly when spraying rollers with known devices. The relatively coarse-grained graphite, on the one hand, and the polymers tending to gum the nozzle opening, on the other hand, continuously reduced the throughput in known spray devices and finally cloggings occurred. These problems are solved by the invention device (and the invention process).

Advantageously, the plunger exhibits, axially to the coupling side, an intake duct (3) for the disperse system, from which one or more output ducts (4) branch off toward the nozzle side end. Advantageously, output duct or ducts (4) are placed branched at an angle to intake duct (3) so that the disperse system radially to tangentially strikes the inside wall of spray head (5) configured as hollow space (2) or offset parallel to the axis to intake duct (3) so that the disperse system axially strikes the inside wall of spray head (5) configured as hollow space (2). Advantageously, plunger (1) exhibits one or more ducts (6) which, starting from the coupling side of the plunger offset parallel to the axis running through the plunger laterally to the plunger tip, comes out into hollow space (2) of spray head (5). Advantageously, the nozzle side end of plunger (1) exhibits a conical shape with an angle of taper of 15° to 90° and the inside of hole type nozzle (7) is matched to the plunger tip and the plunger, in its longitudinal direction, is configured to be movable by a spring (8) so that during the spraying process it is pressed back by the spraying pressure from spray head (5) and as soon as the spraying pressure drops to an undesired volume it is shoved permanently in front of the opening of hole type nozzle (7). Advantageously, coupling (9) is designed as a holder of the spray device. Advantageously, coupling (9) axially exhibits a passage duct (10) for the disperse system and is connected either axially or radially to housing (11) of the spray device. Advantageously, coupling (9) is designed as a screw or plug coupling, preferably as a plug coupling.

The invention also involves a process for using the invention device for spraying of rollers during the hot rolling of sheets, hollow sections and other shapes, with a graphite-containing dispersion which contains graphite having a grain size of 50 to 150 microns.

BRIEF DESCRIPTION OF THE DRAWINGS

The invention is explained, by way of example, in greater detail below by the drawings. In the drawings.

DETAILED DESCRIPTION OF THE INVENTION

Figure 1:
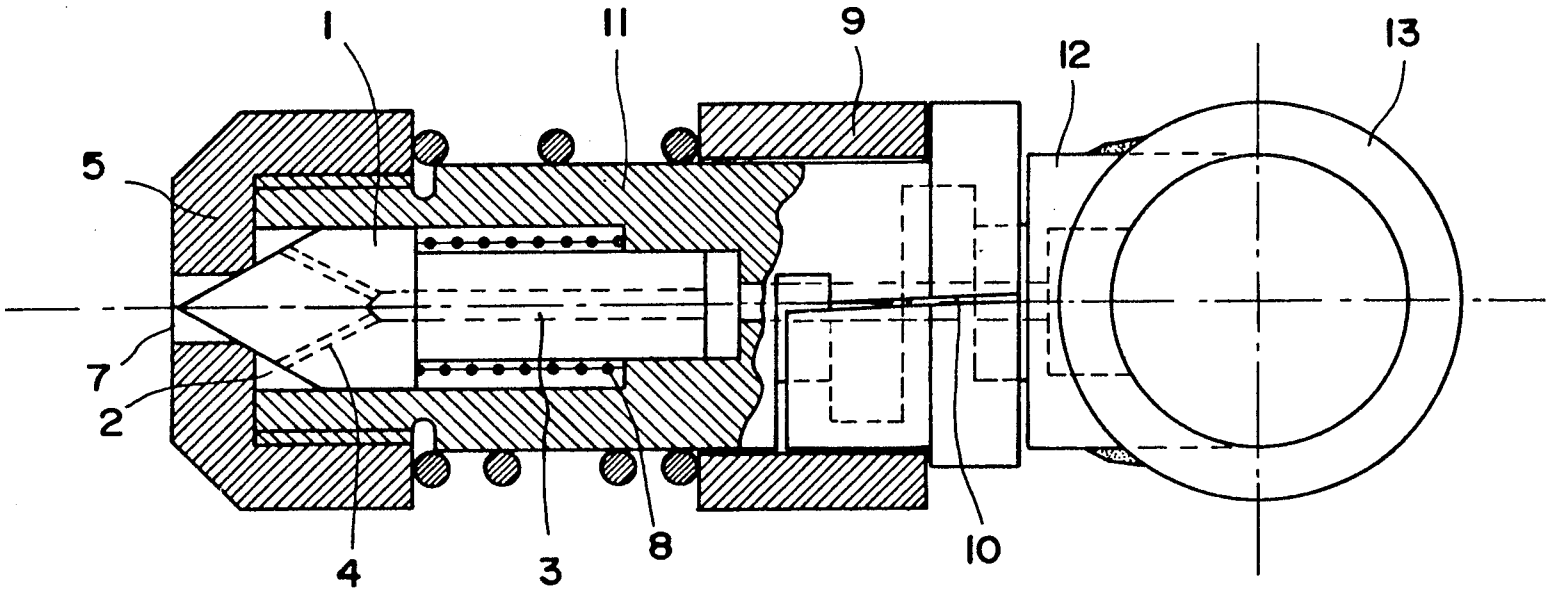
FIG. 1 is a partial axial section through a first embodiment of the device of the invention.

According to FIG. 1, plunger (1), which is movable in the longitudinal direction by means of spring (8), is placed in housing (11) which, on one side, is connected to spray head (5) and, on the opposite side, to coupling (9). Plunger (1) on the coupling side has intake duct (3) for the disperse system, from which two output ducts (4) branch off toward the nozzle side end, according to FIG. 1. In the embodiment according to FIG. 1, the number of output ducts can vary between one and ten, preferably between three and six. Output ducts (4) are preferably designed as bores with diameters suitably between 0.5 and 3 mm.

Figure 2:
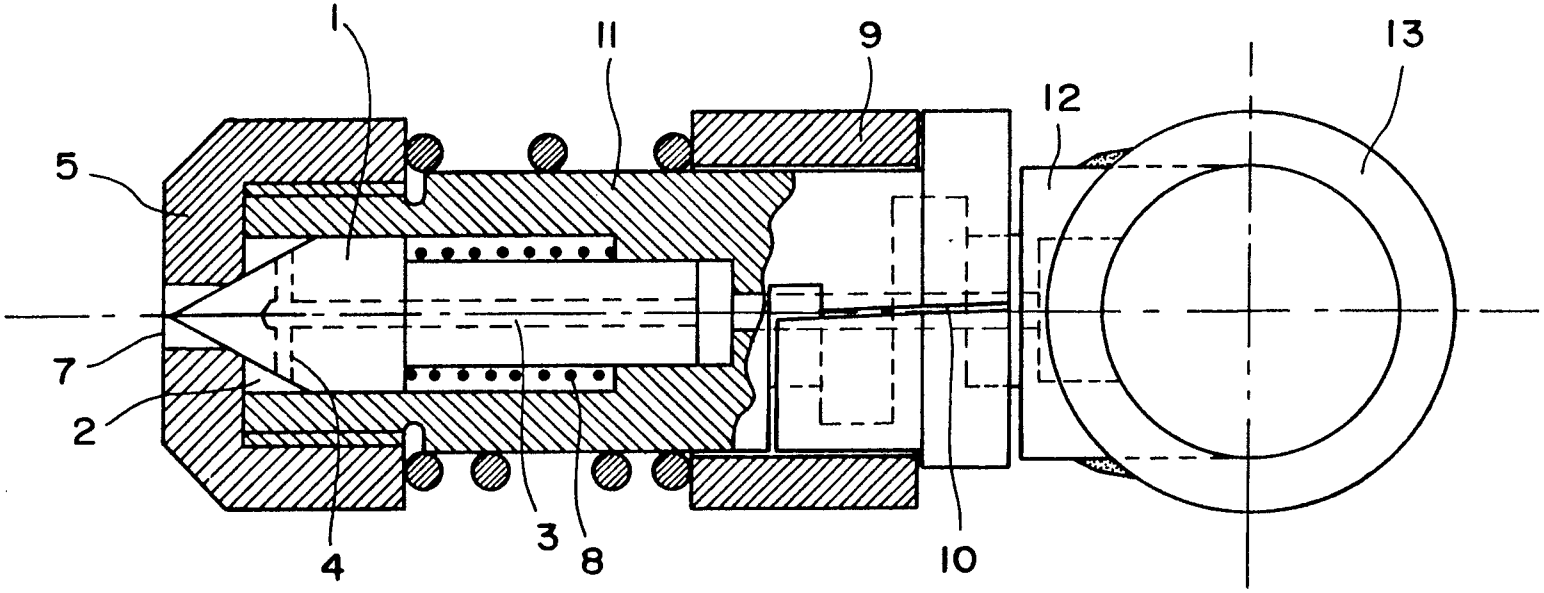
FIG. 2 is a partial axial section through another embodiment of the device of the invention with a modified guiding of the outlet ducts in the plunger.
Figure 4:
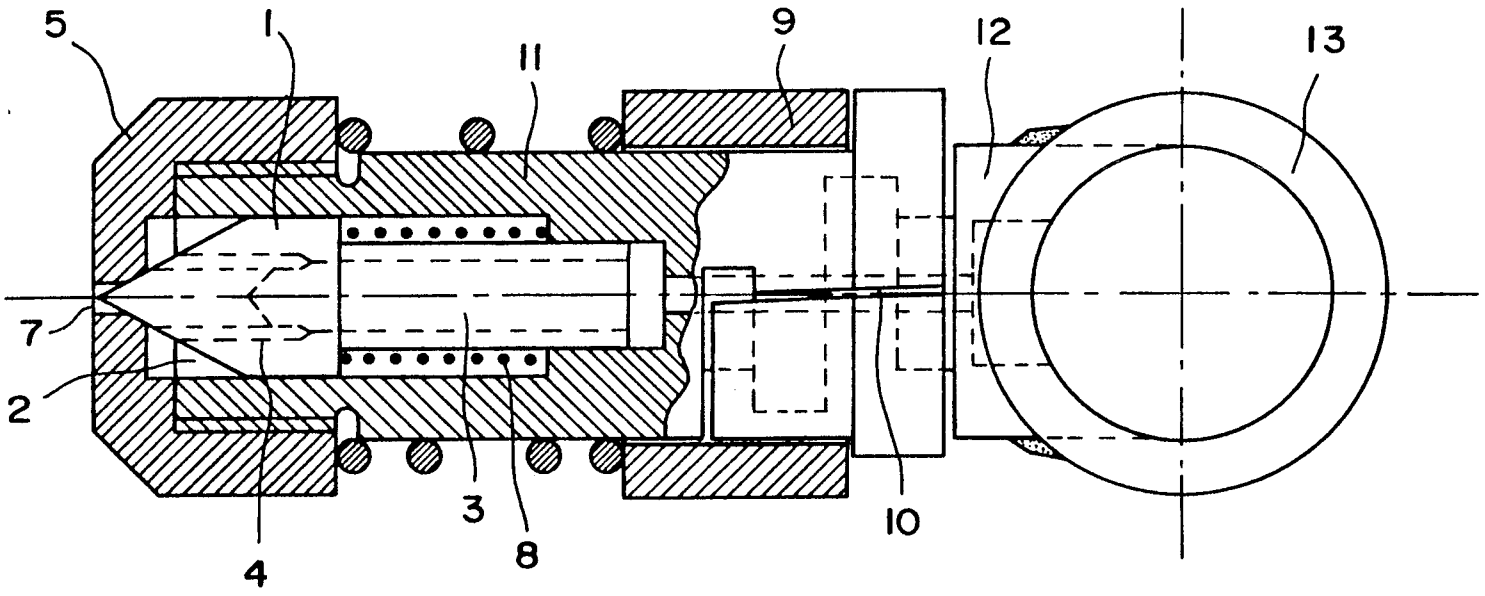
FIG. 4 is a partial axial section through another embodiment of the device of the invention with a modified guiding of the ducts in the plunger.

Output ducts (4) in this case can be placed, e.g., according to FIG. 2, at a right angle relative to the axis of the spray device, at any angle to the axis, e.g., according to FIG. 1, or offset parallel to the axis according to FIG. 4 .

Figure 3:
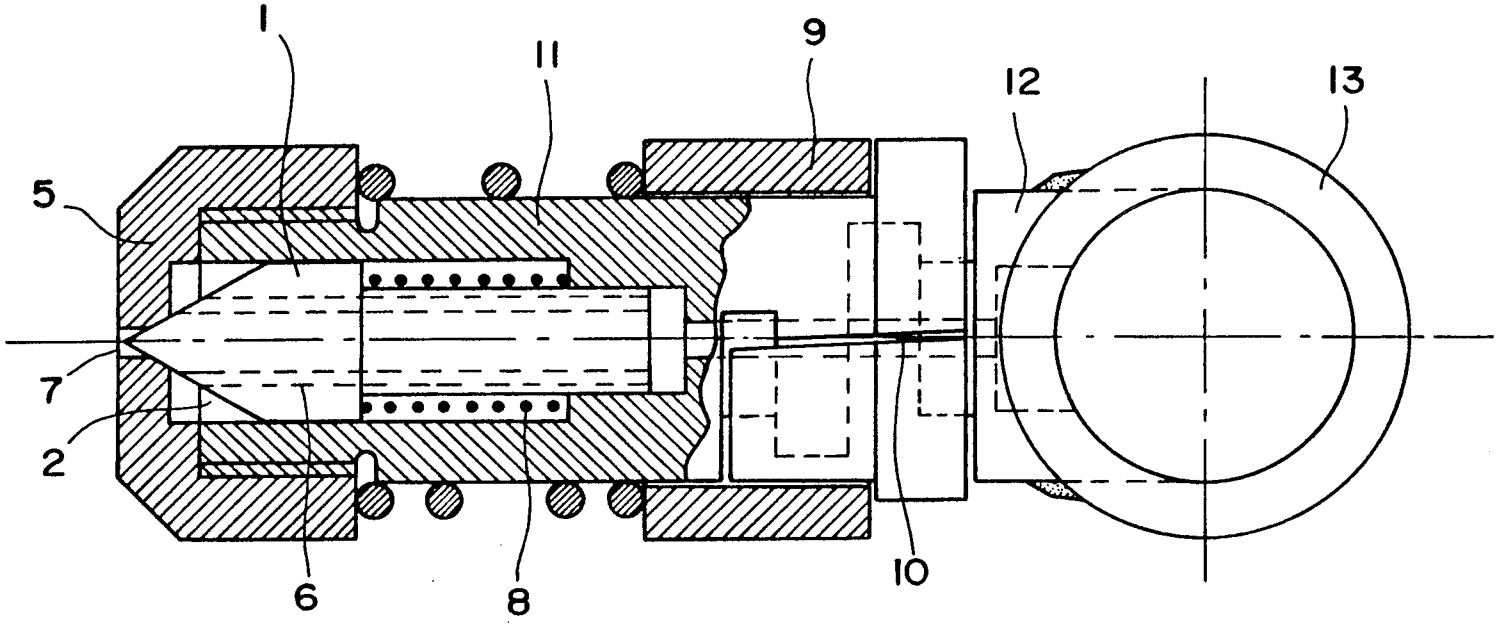
FIG. 3 is a partial axial section through another embodiment of the device of the invention with a modified guiding of the ducts in the plunger.

By the different configuration of these ducts designed as bores it can be achieved that the disperse system radially to tangentially or axially strikes the inside wall of spray head (5) configured as hollow space (2). In another embodiment, according to FIG. 3, in plunger (1), offset parallel to the axis, one or more, suitably one to ten, preferably three to six, ducts (6) are provided which, starting from the coupling side of the plunger laterally to the plunger tip, come out into hollow space (2) of spray head (5). Also these ducts are designed as bores whose diameters vary between 0.5 and 3 mm.

It is common to all embodiments of the invention that the nozzle side end of plunger (1) exhibits a conical tip. The angle of taper is suitably 15° to 90° . Hole type nozzle (7) toward the housing inside is matched in its shape to plunger (1). The opening of hole type nozzle (7) can have the shape of a flat section or circular section jet. The diameter of the nozzle is adjusted to the desired throughput and spray pattern and suitably is 0.3 to 4 mm.

Plunger (1) is designed to be movable in its longitudinal direction by spring (8) so that during the spraying process it is pressed back by the spraying pressure from spray head (5) and, as soon as the spraying pressure drops to an undesired volume, it is shoved permanently in front of the opening of hole type nozzle (7).

Figure 5:
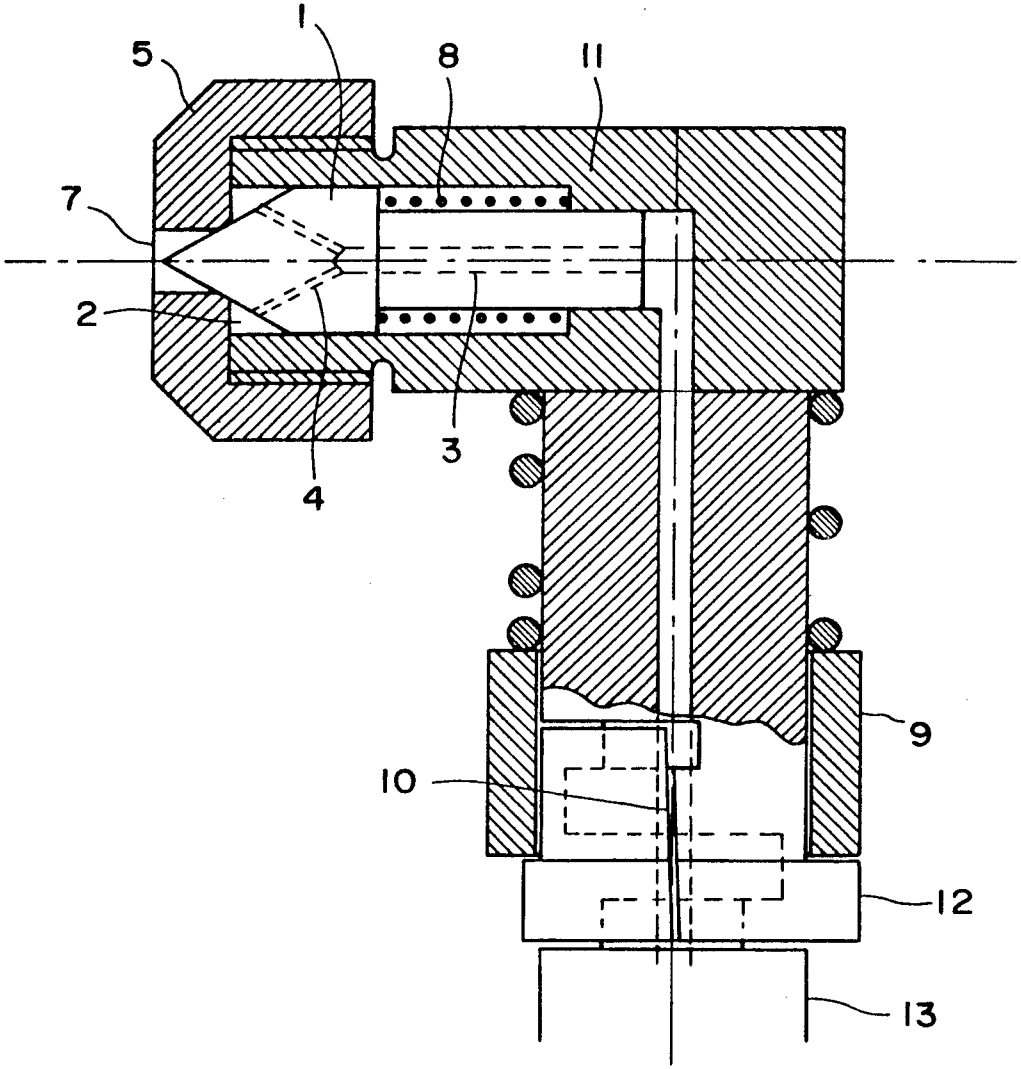
FIG. 5 is a partial axial section through another embodiment of the device of the invention with radial connection of the coupling to the plunger device.
Figure 6:
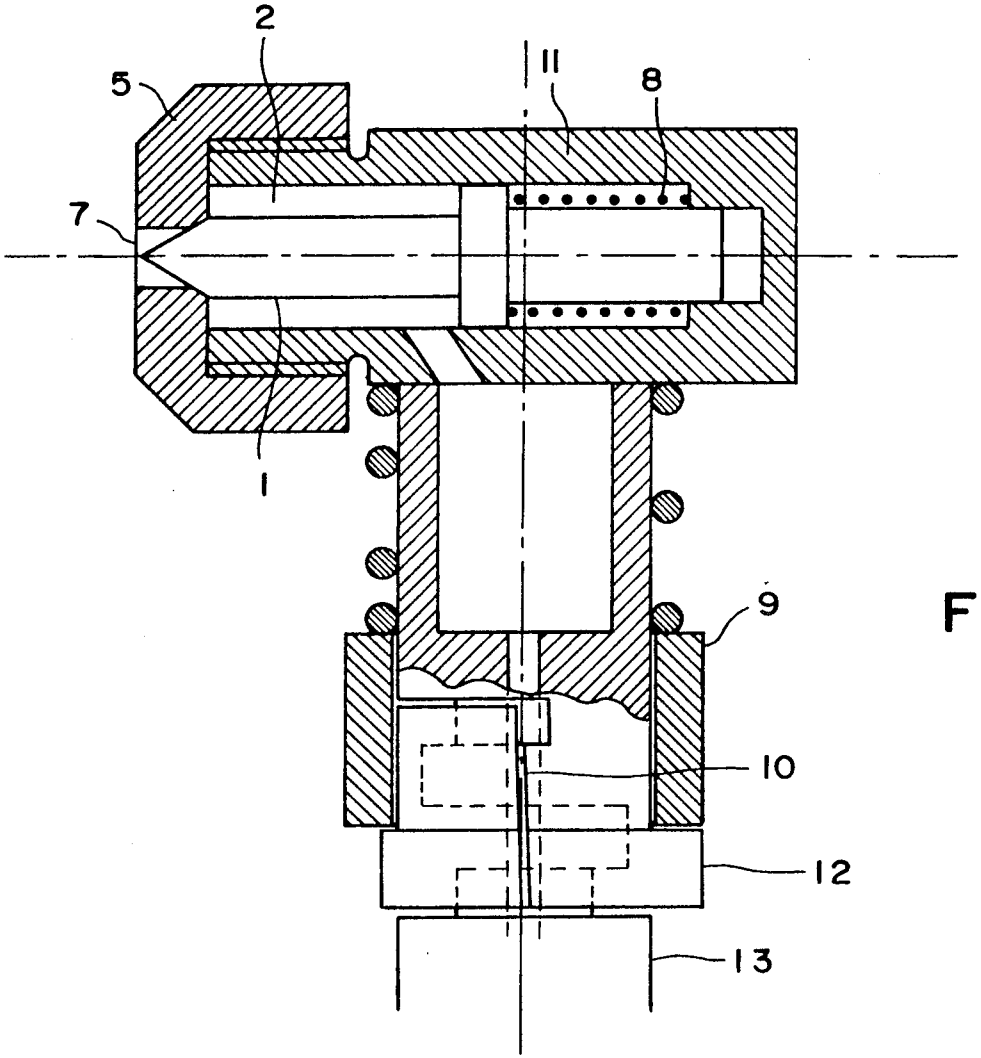
FIG. 6 shows a partial axial section of a variation of the embodiment according to FIG. 5 not belonging to the invention.

Coupling (9) is suitably designed as a plug or screw coupling and suitably exhibits axially a flow duct (10) for the disperse system. Coupling (9), according to FIGS. 1 to 4, can be connected axially to the spray device or, according to FIG. 5, radially to the spray device. If, according to the configuration of FIG. 5, coupling (9) is radially connected to the spray device, according to FIG. 6, the disperse system can be guided directly into hollow space (2) of spray head (5) without passing through ducts of the plunger.

Coupling (9) preferably is used at the same time as a holder of the spray device. By this design a small installation height is achieved which means an enormous advantage, especially in the installation of the nozzle devices in rolling stands which offer only very scant space for additional installations. Preferably, a plug coupling is used which is configured so that, with a handle, it can be inserted with a radial movement into counterhousing (12) o supply element (13) and be radially locked. The spray device is supplied with the disperse system by supply element (13), which is configured as a supply pipe or distributor with pump devices known in the art. The pressures used in this case are in the range of 5 to 100 bars, suitably between 20 and 80 bars.

Coarse-grained materials and polymers tending to gum can be sprayed without reduction of the throughput with the device according to the invention. As soon as the throughput of the disperse system drops to an undesired volume, or in a regular sequence, the plunger is briefly pressed from the hollow space in the spray head on the hole type nozzle, by which particles possibly clogging the hole type nozzle are pressed out through the latter. After the retraction of the plunger, the hole type nozzle is again fully operative.

Hole type nozzles with nozzle openings of 0.5 to 1.0 mm are used for such suspensions. The spray device can also be used for other known disperse systems which, for example, on contact with the air tend to gum, or because of the particle size of the disperse phase thus far have been able to be sprayed poorly or not at all with known devices. The plunger can be controlled so that, after stopping of the feeding of the disperse system, it is pressed into the hole type nozzle, thereby at the same time cleaning and securely sealing the hole type nozzle. With a renewed feeding of the disperse system, the plunger can again be retracted into the spray head.

The device according to the invention is used especially for spraying of graphite-containing dispersions containing graphite with a grain size of 25 to 150 microns, during the hot rolling of sheets, sections and other shapes.

What is claimed is:

1. Device for spraying a disperse system comprising a spray head having a nozzle, the nozzle comprising a hole through the spray head having a rear opening, an intake for the disperse system, a plunger able to slide inside of the spray head upstream of the hole of the nozzle, and a coupling connection to a supply element, the plunger having a plunger head on an end of the plunger which is proximate the hole of the nozzle, the coupling connection being located on an end of the plunger away from the plunger head, the plunger head being tapered toward the hole of the nozzle so as to form a conical end which fits into the hole of the nozzle as a closure therefor, a hollow space being formed between the plunger head and the spray head, the plunger having at least one output duct for the disperse system which, going from the coupling side of the plunger, through the plunger and through the plunger head, comes out the conical end of the plunger head into the hollow space between the plunger head and the spray head.

2. Device according to claim 1 wherein the plunger has, axially to the coupling end, an intake duct for the disperse system, from which said at least one output duct branches off through the nozzle plunger head.

3. Device according to claim 2 wherein the spray head has an inside wall which forms part of the hollow space, and at least one output duct is branched at an angle to the intake duct so that the disperse system radially to tangentially strikes the inside wall of the spray head.

4. Device according to claim 2 wherein the spray head has an inside wall which forms part of the hollow space, the plunger has a longitudinal axis, the intake duct being located along the longitudinal axis of the plunger, and the at least one output duct is offset parallel to the intake duct so that the disperse system axially strikes the inside wall of the spray head.

5. Device according to claim 1 wherein the plunger and the plunger head have a longitudinal axis, and the at least one output duct which, starting from the coupling side of the plunger, is offset parallel to the longitudinal axis, runs through the plunger laterally to the longitudinal axis, runs through the plunger head laterally to the longitudinal axis, and comes out into the hollow space.

6. Device according to claim 5 wherein the hole has an inside, the plunger head has a conical angle of taper of 15° to 90° the inside of the hole of the nozzle is matched to the conical end of the plunger head, the plunger is configured to be movable by a spring along its longitudinal axis so that, during the spraying, the plunger is pressed back by the spraying back pressure and, as soon as the spraying back pressure drops to an undesired volume, the plunger is shoved permanently in front of the rear opening of the hole of the nozzle with the conical end of the plunger head positioned in the hole of the nozzle.

7. Device according to claim 6 wherein the coupling connection includes a coupling designed as a holder for the device.

8. Device according to claim 7 wherein the device has a housing, the coupling has an axial passage duct for the disperse system, and the coupling is connected axially to the housing.

9. Device according to claim 7 wherein the device has a housing, the coupling has an axial passage duct for the disperse system, and the coupling is connected radially to the housing.

10. Device according to claim 7 wherein the coupling is designed as a screw coupling.

11. Device according to claim 7 wherein the coupling is a plug coupling.

12. Device according to claim 8 wherein the coupling is designed as screw coupling.

13. Device according to claim 8 wherein the coupling is a plug coupling.

14. Process comprising spraying rollers, during the hot rolling of a metal material into at least one shaped metal object, with a dispersion containing graphite having a grain size of 25 to 150 microns, the spraying being done with a device for spraying a disperse system comprising a spray head having a nozzle, the nozzle comprising a hole through the spray head having a rear opening, an intake for the disperse system, a plunger able to slide inside of the spray head upstream of the hole of the nozzle, and a coupling connection to a supply element, the plunger having a plunger head on an end of the plunger which is proximate the hole of the nozzle, the coupling connection being located on an end of the plunger away from the plunger head, the plunger head being tapered toward the hole of the nozzle so as to form a conical end which fits into the hole of the nozzle as a closure therefor, a hollow space being formed between the plunger head and the spray head, the plunger having at least one output duct for the disperse system which, going from the coupling side of the plunger, through the plunger and through the plunger head, comes out the conical end of the plunger head into the hollow space between the plunger head and the spray head.

15. Process according to claim 14 wherein the at least one shaped metal object is at least one sheet.

16. Process according to claim 14 where the at least one shaped metal object is at least one hollow section.

17. Process according to claim 14 wherein the spray head has an inside wall which forms part of the hollow space, the plunger has a longitudinal axis, an intake duct connected to the at least one output duct being located along the longitudinal axis of the plunger, and the at least one output duct is offset parallel to the intake duct so that the disperse system axially strikes the inside wall of the spray head.

18. Process according to claim 14 wherein the plunger and the plunger head have a longitudinal axis, and the at least one output duct which, starting from the coupling side of the plunger, is offset parallel to the longitudinal axis, runs through the plunger laterally to the longitudinal axis, runs through the plunger head laterally to the longitudinal axis, and comes out into the hollow space.

* * * * *